US010765202B2

(12) United States Patent
Krystalovich

(10) Patent No.: US 10,765,202 B2
(45) Date of Patent: Sep. 8, 2020

(54) FOLDABLE LOCKER ASSEMBLY

(71) Applicant: Dale Krystalovich, St. Louis, MO (US)

(72) Inventor: Dale Krystalovich, St. Louis, MO (US)

(73) Assignee: Boxes, Inc., St. Louis, MO (US)

( * ) Notice: Subject to any disclaimer, the term of this patent is extended or adjusted under 35 U.S.C. 154(b) by 0 days.

(21) Appl. No.: 16/204,359

(22) Filed: Nov. 29, 2018

(65) Prior Publication Data

US 2019/0159591 A1 May 30, 2019

Related U.S. Application Data

(60) Provisional application No. 62/592,079, filed on Nov. 29, 2017.

(51) Int. Cl.
*A47B 43/02* (2006.01)
*A47B 61/06* (2006.01)
*A47F 5/11* (2006.01)

(52) U.S. Cl.
CPC ..... *A47B 43/02* (2013.01); *A47B 61/06* (2013.01); *A47F 5/112* (2013.01)

(58) Field of Classification Search
CPC ..... A47B 43/02; A47B 61/06; A47F 5/112
See application file for complete search history.

(56) References Cited

U.S. PATENT DOCUMENTS 1,217,298 A * 2/1917 Grube ..... A47B 61/06 190/3
1,340,565 A * 5/1920 Seidenburg ..... A47B 61/06 211/1.3
1,342,269 A * 6/1920 Stewart ..... A47B 43/02 312/258
1,449,525 A * 3/1923 McNamara ..... A47B 61/06 190/13 F
1,947,955 A * 2/1934 Stone ..... A47B 43/02 220/4.29
2,097,043 A * 10/1937 Reefer ..... A47B 61/06 206/290
2,235,574 A * 3/1941 Derman ..... A47B 43/02 312/260

(Continued)

FOREIGN PATENT DOCUMENTS

DE 1924252 A1 * 11/1970 ..... A47B 3/00
DE 2526155 A1 * 12/1976 ..... A47B 43/02

(Continued)

*Primary Examiner* — Stanton L Krycinski

(57) ABSTRACT

A foldable locker assembly is configurable between a generally laid flat configuration and an assembled configuration in which the assembly generally forms a locker. The locker assembly includes a main panel configurable between a generally laid-flat configuration and a folded configuration. In the folded configuration the main panel forms a back wall and opposite side walls of the locker assembly. A shelf panel is configurable between a generally laid-flat configuration and a folded configuration. In the folded configuration the shelf panel at least in part forms a shelf of the locker assembly. A bench is configurable between a generally laid-flat configuration and a folded configuration. In the folded configuration the bench panel at least in part forms a bench of the locker assembly with the bench being in spaced relationship with the shelf panel.

17 Claims, 12 Drawing Sheets

(56) References Cited

U.S. PATENT DOCUMENTS 2,486,745 A * 11/1949 Harris ..... A47B 43/02 220/6
2,522,561 A * 9/1950 Blechman ..... A47B 43/02 312/259
3,460,790 A * 8/1969 Baird ..... A47B 43/02 248/165
3,552,529 A * 1/1971 Marshall ..... A47B 61/06 190/13 R
3,738,604 A * 6/1973 Howlett ..... A47B 43/02 248/459
4,437,713 A * 3/1984 Roach ..... A47B 43/02 206/526
4,463,997 A * 8/1984 Densen ..... A47B 43/02 229/120.32
4,512,477 A * 4/1985 Densen ..... A47B 43/02 206/292
4,723,664 A * 2/1988 Smith ..... A47C 5/005 211/132.1
RE32,668 E * 5/1988 Smith ..... A47F 5/116 211/132.1
5,145,244 A * 9/1992 Kersting ..... A47B 43/02 211/149
5,259,578 A * 11/1993 Jones ..... A47C 5/005 211/24
5,458,411 A * 10/1995 Moss ..... A47B 47/06 312/259
6,126,254 A * 10/2000 Maglione ..... A47B 43/02 248/174
6,612,669 B2 * 9/2003 Grueneberg ..... A47B 43/02 108/165
7,007,615 B2 * 3/2006 Grueneberg ..... A47B 43/02 108/165
7,946,664 B2 * 5/2011 Vail ..... A47B 43/02 108/157.14
9,204,738 B2 * 12/2015 Sitton ..... A47F 5/118
9,474,389 B2 * 10/2016 Pfeifer ..... A47F 5/11
2007/0176525 A1 * 8/2007 Yoon ..... A47B 43/02 312/258
2008/0110712 A1 * 5/2008 Strong ..... A47B 61/06 190/13 R
2008/0155944 A1 * 7/2008 Bertele ..... A47B 43/02 53/450
2008/0237319 A1 * 10/2008 Hensey ..... A47B 3/00 229/103
2011/0011313 A1 * 1/2011 Yang ..... A47B 3/06 108/158.12
2018/0014639 A1 * 1/2018 Vincent ..... A47B 43/02
2018/0325287 A1 * 11/2018 Lopez Fern Ndez ..... B65D 5/5206

FOREIGN PATENT DOCUMENTS

EP 0533963 A1 * 3/1993 ..... A47B 43/02
EP 1099398 A1 * 5/2001 ..... A47B 43/02
EP 2253249 A1 * 11/2010 ..... A47B 43/02
EP 2294941 A1 * 3/2011 ..... A47B 43/02
FR 1522560 A * 4/1968 ..... A47B 17/00
FR 2853509 A1 * 10/2004 ..... A47B 43/02
GB 346549 A * 4/1931 ..... A47B 43/02
GB 570311 A * 7/1945 ..... A47B 61/06
GB 904909 A * 9/1962 ..... A47B 61/06
WO WO-2011016021 A1 * 2/2011 ..... A47B 3/00

* cited by examiner

FOLDABLE LOCKER ASSEMBLY

CROSS-REFERENCE TO RELATED APPLICATIONS

This application claims priority to U.S. Provisional Patent Application Ser. No. 62/592,079, filed Nov. 29, 2017, the disclosure of which is incorporated herein by reference in its entirety.

BACKGROUND

The field of this invention relates generally to lockers used for storing various items, and more particularly to a locker assembly constructed of paperboard or other lightweight foldable material so as to be lightweight, durable and configurable in a substantially laid flat configuration for transport and storage.

Lockers are commonly used for storing items of various sizes. For example, some lockers are relatively tall and narrow for temporarily storing or holding clothes while other lockers may be smaller and use for temporarily storing or holding smaller items such as books, shoes, purses, etc. Lockers may have a door panel that closes to form an enclosure in which the items are stored hidden from view and may even include a lock or at least a mechanism on which a lock may be placed to secure the door panel in a closed position. Other lockers, such as those commonly used in sports locker rooms, are open in the front and may include a seat or bench on which a person may sit while getting dressed or otherwise using the locker.

Conventional lockers are typically constructed of metal, wood or even strong, relatively thick plastic and are typically intended for a relatively permanent placement, e.g., it is rather heavy, bulky and difficult to move. Moreover, it is typically assembled and transported in its fully assembled state, rendering it bulky for transport, or assembled in such a manner that the fully assembled locker is intended to remain in its assembled condition.

In light of the foregoing, there is a need for a lightweight locker assembly that can be transported unassembled and in a laid flat configuration and then assembled at a desired location, easily carried or moved from one location to another and is durable for prolonged use in the manner of a conventional locker.

SUMMARY

In one embodiment, a foldable locker assembly is configurable between a generally laid flat configuration and an assembled configuration in which the assembly generally forms a locker. The locker assembly generally comprises a main panel configurable between a generally laid-flat configuration and a folded configuration. In the folded configuration the main panel forms a back wall and opposite side walls of the locker assembly. A shelf panel is configurable between a generally laid-flat configuration and a folded configuration. In the folded configuration the shelf panel at least in part forms a shelf of the locker assembly. A bench is configurable between a generally laid-flat configuration and a folded configuration. In the folded configuration the bench panel at least in part forms a bench of the locker assembly with the bench being in spaced relationship with the shelf panel.

BRIEF DESCRIPTION OF THE DRAWINGS

Corresponding reference characters indicate corresponding parts throughout the several views of the drawings.

DETAILED DESCRIPTION

Figure 1:
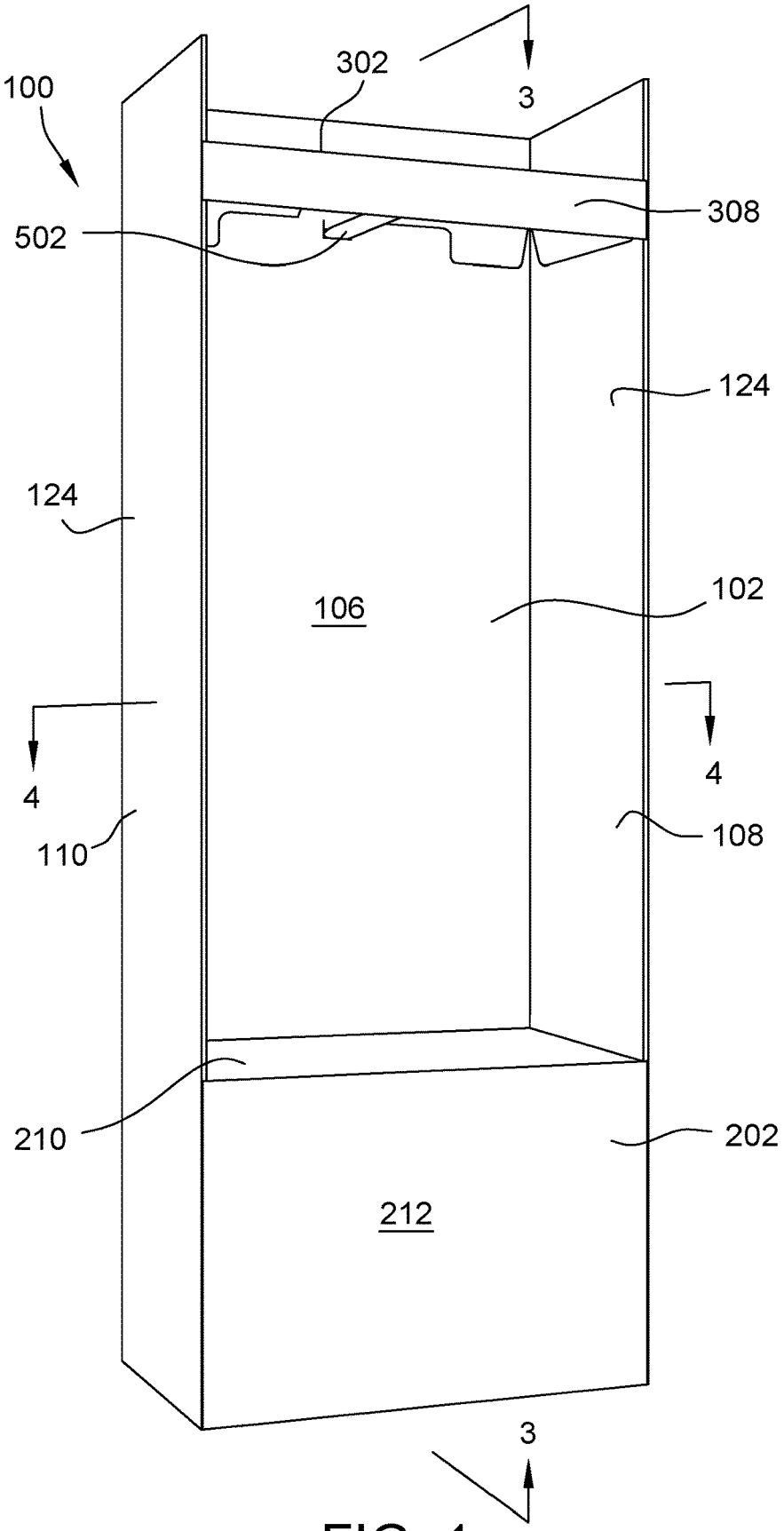
FIG. 1 is a front perspective view of one embodiment of a foldable locker assembly in a folded and assembled configuration thereof.
Figure 2A:
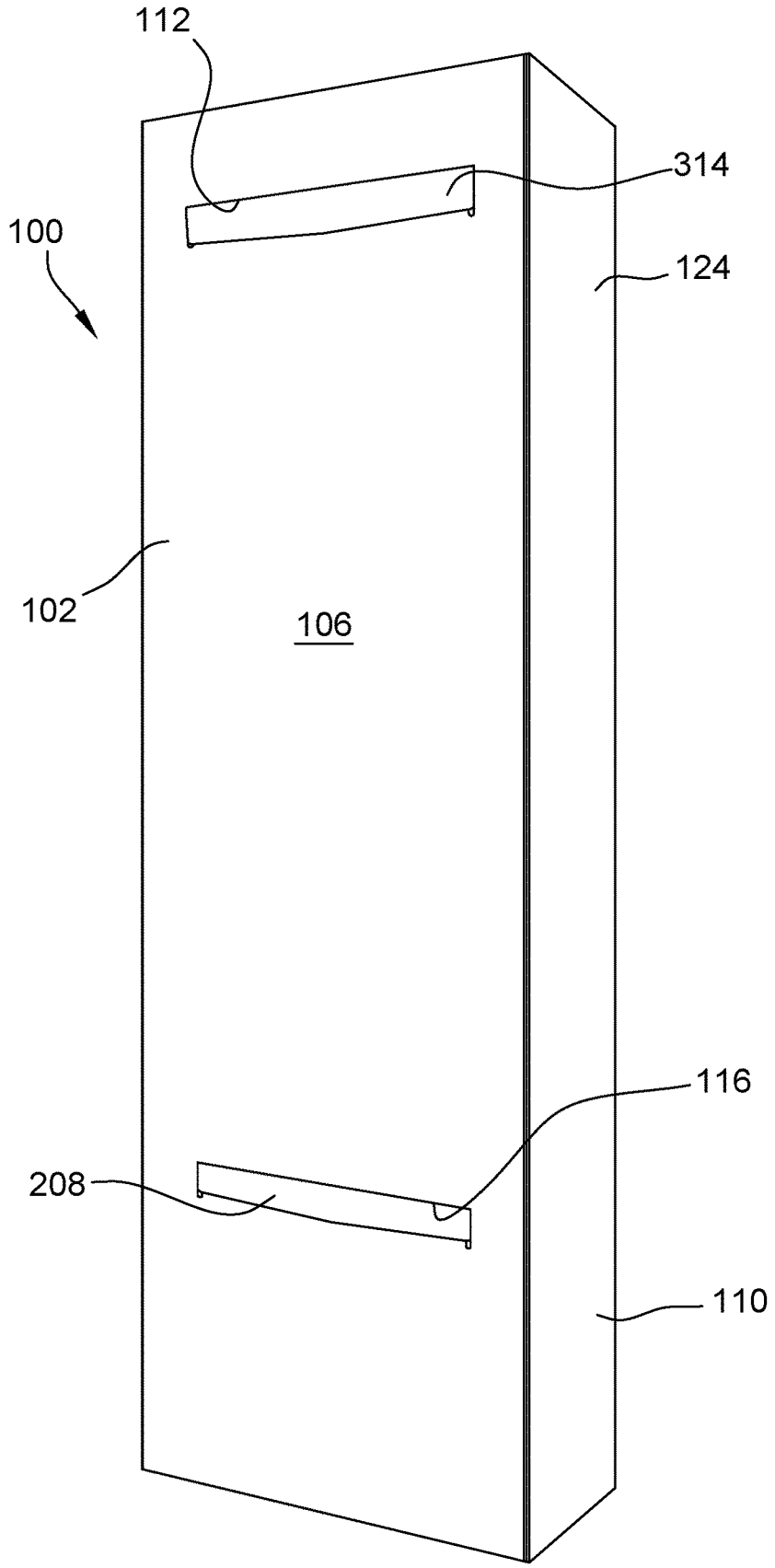
FIG. 2A is a rear perspective view of the locker assembly of FIG. 1.
Figure 2B:
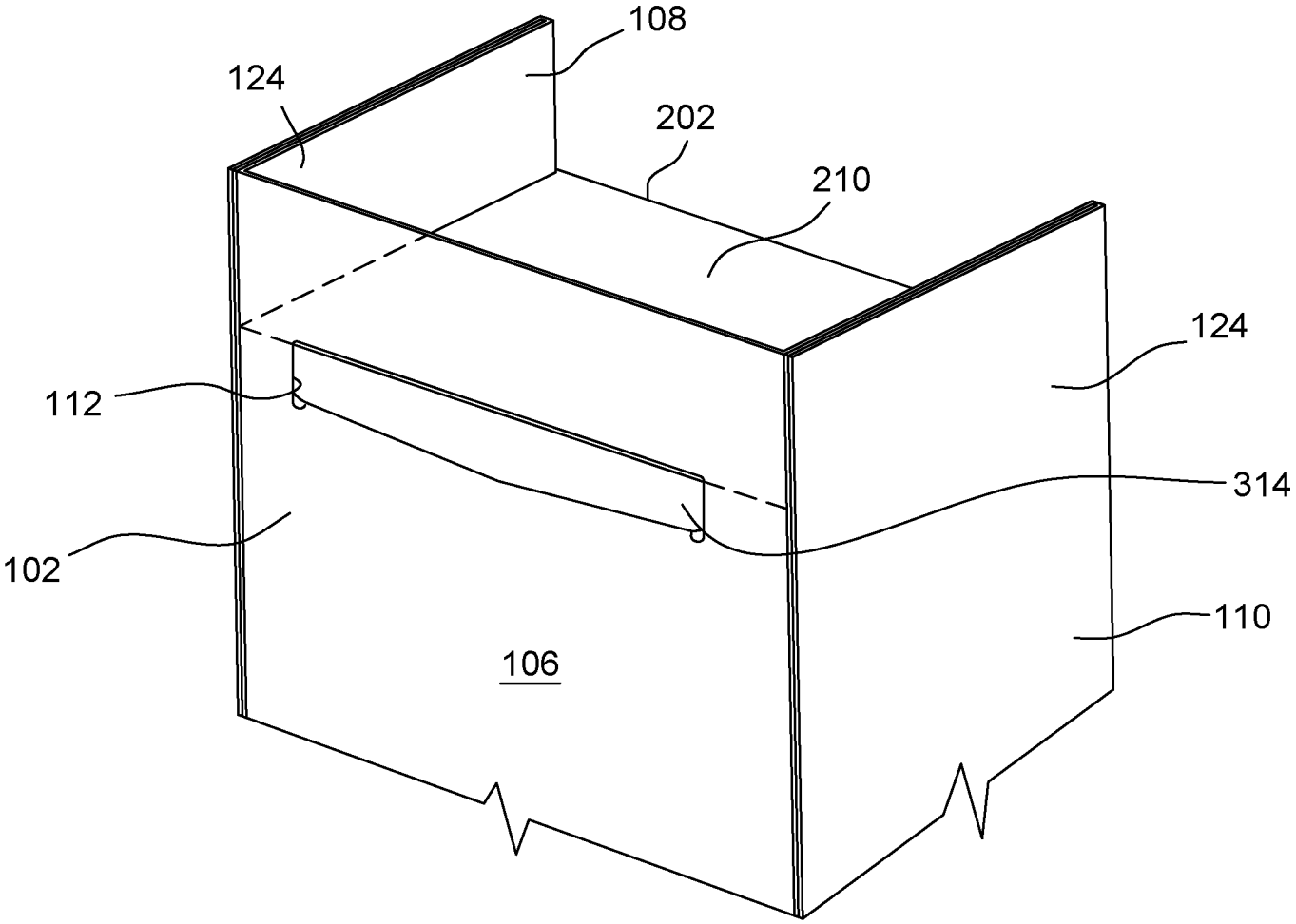
FIG. 2B is a segmented top perspective of the locker assembly of FIG. 1
Figure 3:
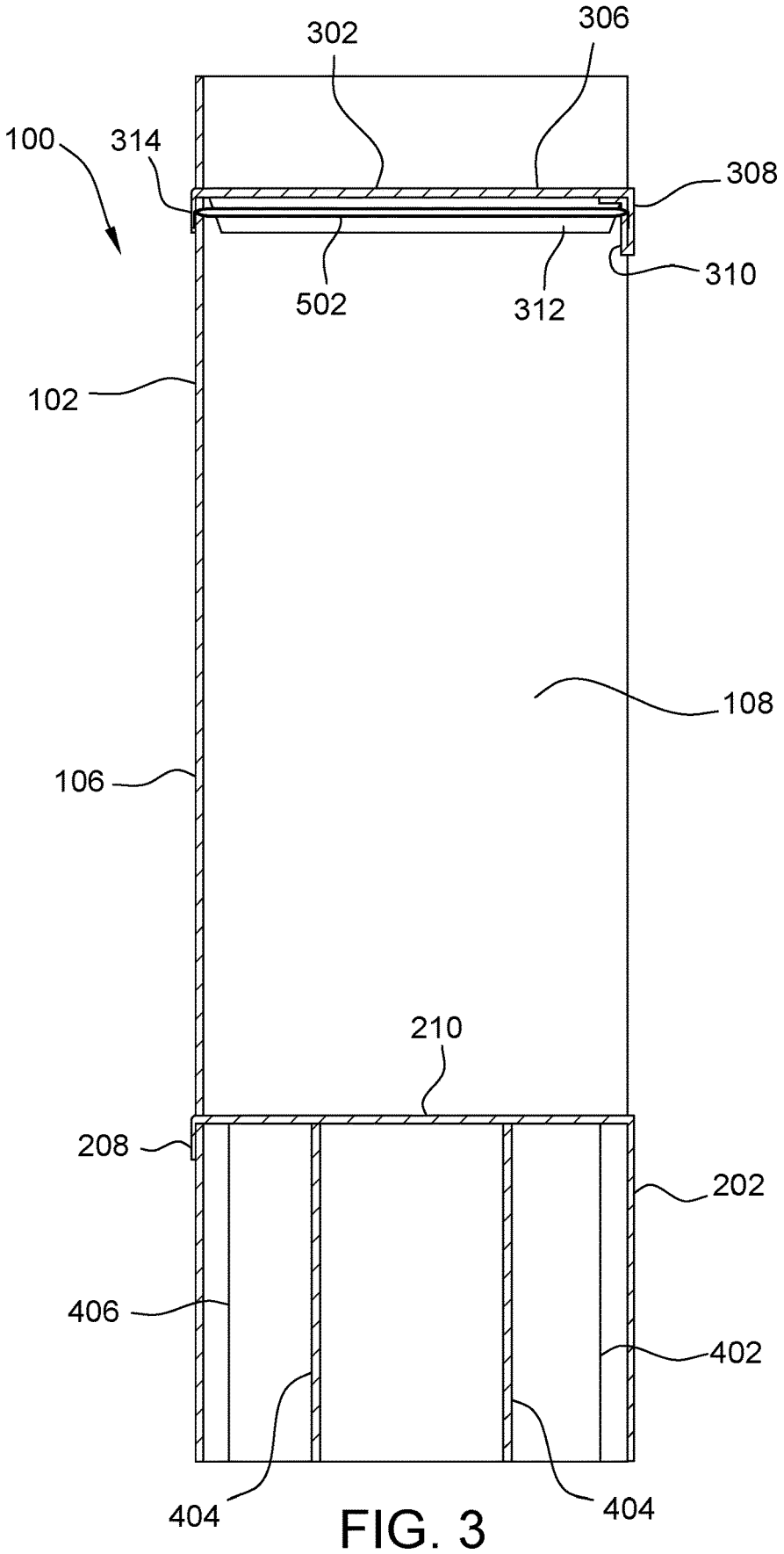
FIG. 3 is a longitudinal cross-section of the locker assembly of FIG. 1 taken in the plane of line 3-3.

Referring now to the drawings and in particular to FIGS. 1, 2A, 2B, 3 and 4, one embodiment of a foldable locker assembly is generally indicated at 100 and includes a main panel 102, a bench panel 202, a shelf panel 302, a bench support 402 and a hanging bar 502. As seen best in FIGS. 5-7, the main panel 102, the bench panel 202, the shelf panel 302 and the bench support 402 are each constructed in an unfolded and generally laid-flat configuration so that these various components of the locker assembly 100 may be packaged with the assembly in a generally laid-flat configuration, such as in a relatively thin rectangular packaging container (not shown), for providing a narrow profile and ease of shipping, transport and/or storage as a packaged unit. With the exception of the hanging bar 502, the various components 102, 202, 302, 402 of the locker assembly 100 are suitably constructed of a lightweight, foldable construction material and in one particularly suitable embodiment these components are constructed of a paperboard construction material. In one example the paperboard is a corrugated liner-board. The hanging bar is suitably constructed of a lightweight metal or plastic. However, it is contemplated that in other embodiments the hanging bar 502 may be constructed of a paperboard material. It is understood, however, that the various components of the locker assembly 100 may be constructed of materials other than paperboard, such as plastic (e.g., corrugated plastic) or other suitable lightweight, foldable construction materials and remain within the scope of this invention. It is also understood that the various components of the locker need not all be constructed of the same material.

Figure 5:
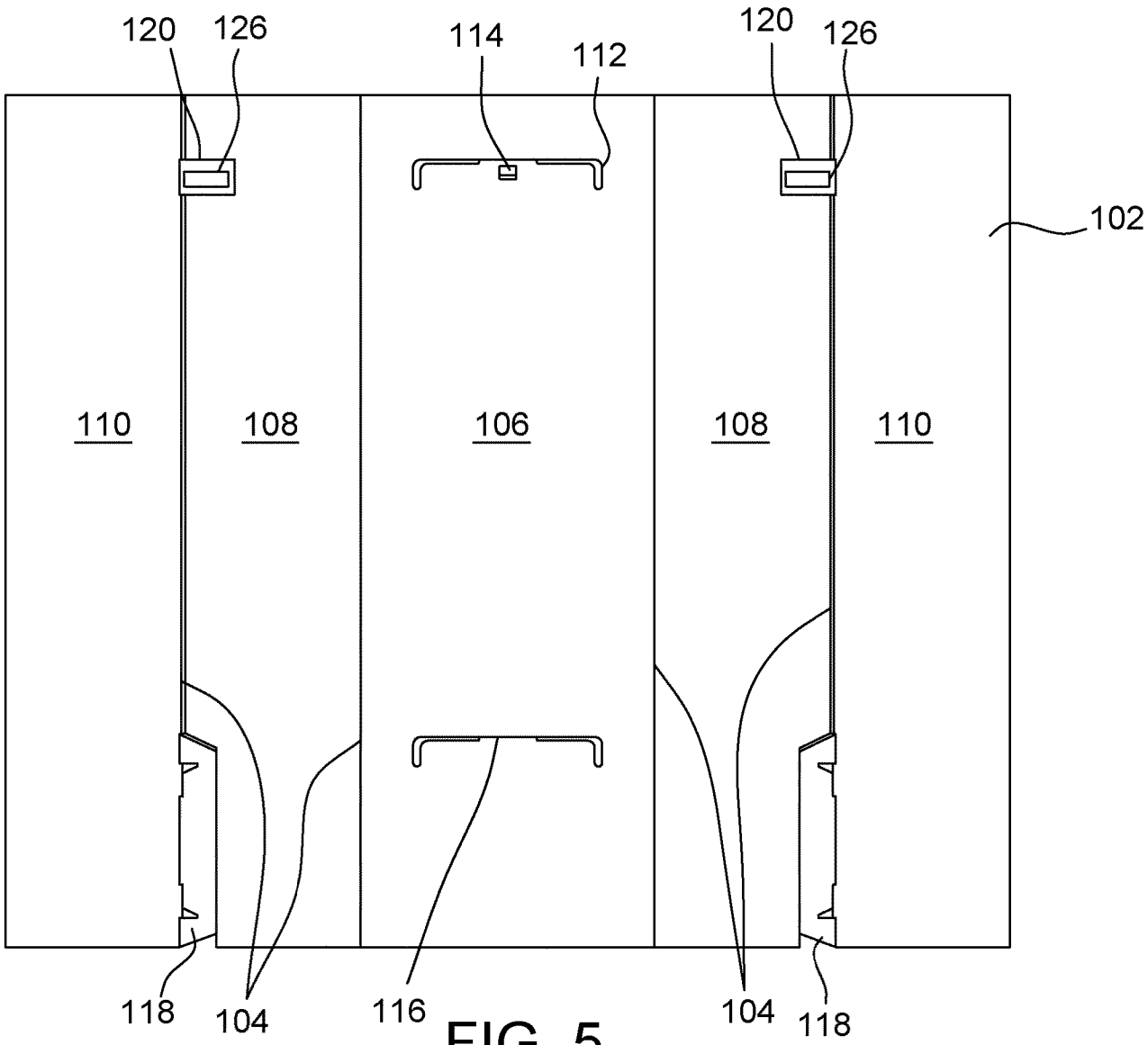
FIG. 5 is a plan view of one embodiment of a suitable main panel of the locker assembly of FIG. 1 with the main panel in an unfolded and laid flat configuration.
Figure 6A:
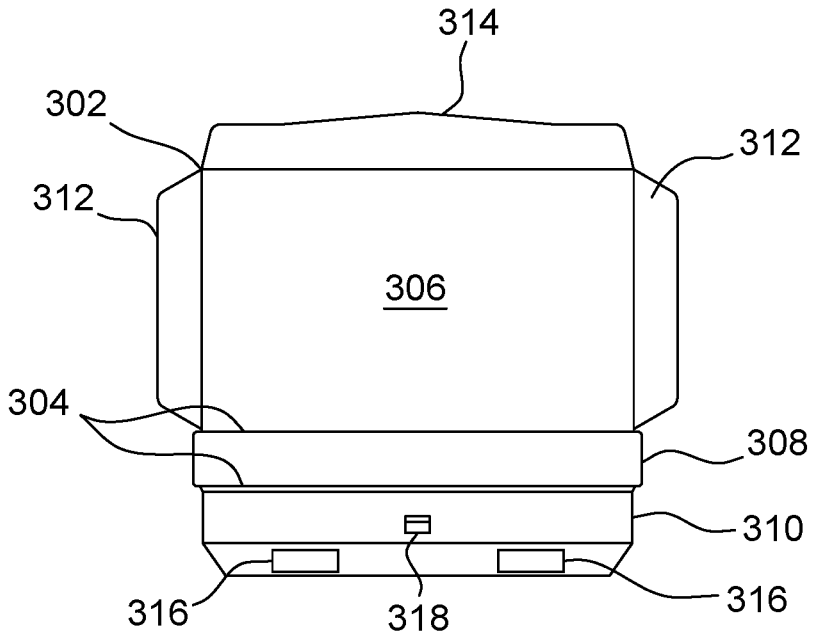
FIG. 6A is a plan view of one embodiment of a suitable shelf panel of the locker assembly of FIG. 1 with the shelf panel in an unfolded and laid flat configuration.
Figure 10:
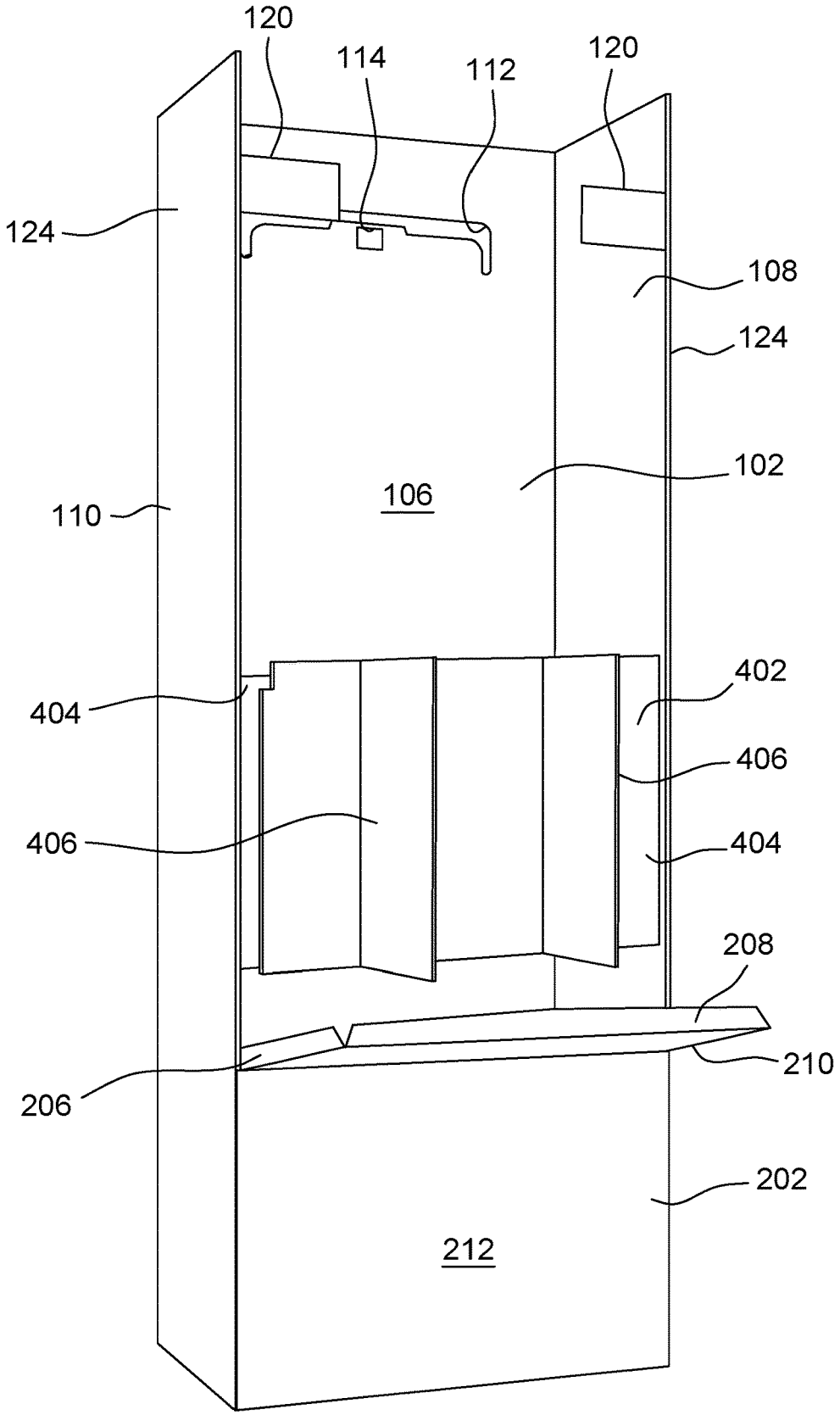
FIG. 10 is a schematic perspective view of the locker assembly of FIG. 1 in a further partially assembled configuration than as shown in FIG. 9.

Referring to FIG. 5, the main panel 102 includes a plurality of fold lines 104 or creases formed in the panel and extending longitudinally along the length of the panel to define a central or back wall 106 of the main panel and hence of the locker assembly 100, a pair of inside walls 108 and a pair of outside walls 110 of the locker. An upper slot 112 is formed in the back wall 106 near the upper end of the main panel 102 for use in securing the shelf panel 302 on the main panel as described in further detail later herein. A separate slot 114 is formed in the back wall 106 just below the upper slot 112 and is sized to facilitate retention of the hanging bar 502 on the locker 100 as seen in FIGS. 1 and 10. A lower slot 116 is also formed in the back wall 106 near the lower end of the main panel 102 for use in securing the bench panel 202 to the main panel.

A pair of lower mounting tabs 118 are formed by cutting out a portion of each of the inside walls 108 along the respective outer edge margins thereof adjacent the lower end of the main panel 102 so that the lower mounting tabs are hinged to the inside walls. Upper mounting tabs 120 are also formed by cutting out a portion of the inside walls 108 along the respective outer margins thereof in spaced relationship with the upper end of the main panel 102 so that these upper mounting tabs are also hinged to the inside walls of the locker 100.

Figure 4:
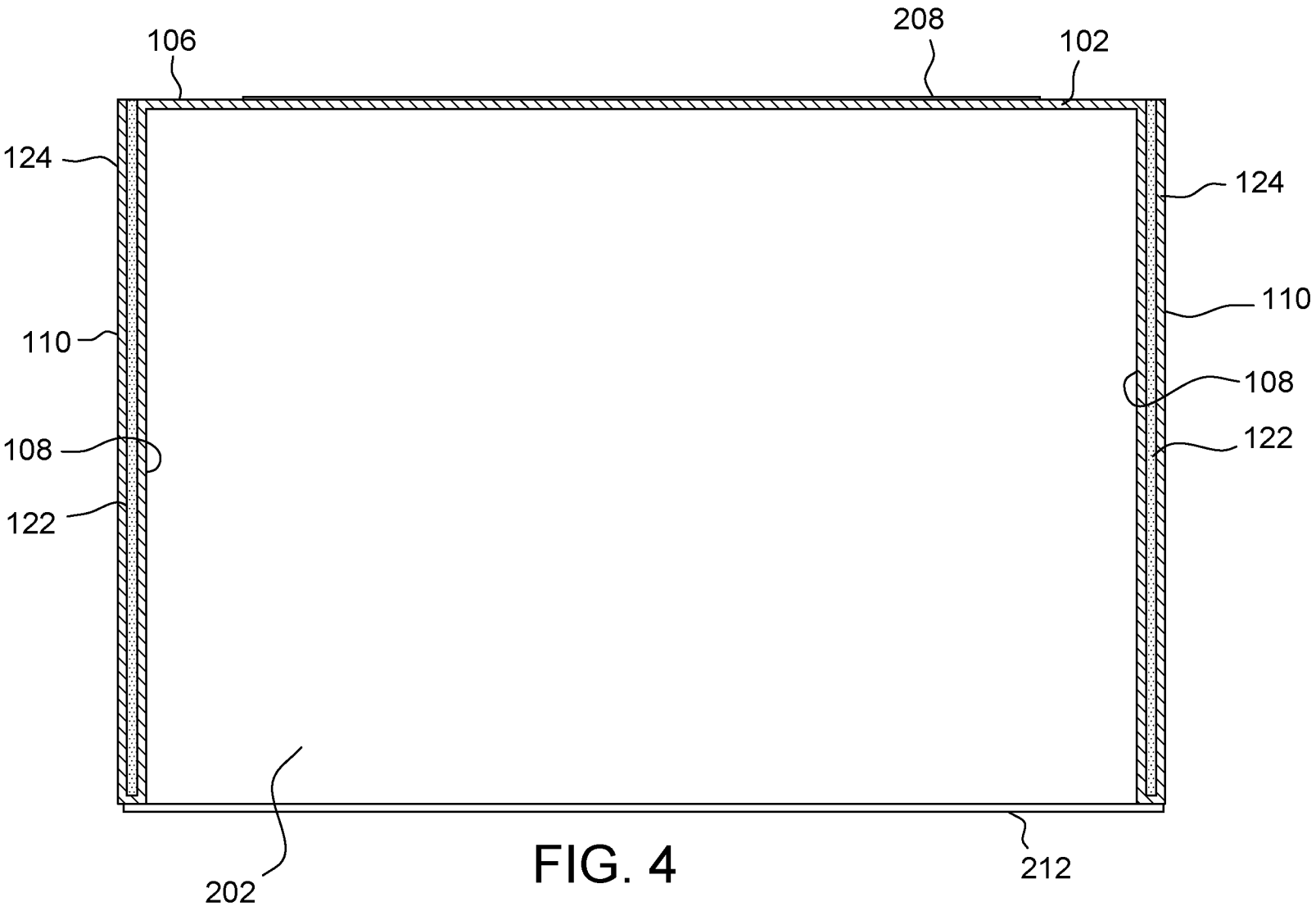
FIG. 4 is a lateral cross-section of the locker assembly of FIG. 1 taken in the plane of line 4-4.

With particular reference to FIG. 4, a pair of elongate inner panels 122 are formed from a single sheet of suitable construction material and are separable for use in assembling the locker assembly 100 to provide enhanced sturdiness and durability to the locker assembly. In particular, each inner panel 122 is shaped in accordance with the shape of a respective one of the inside walls 108 of the locker assembly 100 excluding the lower mounting tabs 118.

In an initial step of assembly, each of the inner panels 122 is adhered to the outer surface of a respective of one of the inside walls 108 of the locker 100 and then the outside walls 110 are folded over and adhered to the inner panels so that the inside walls, inner panels and outside walls together form what will become opposite side walls 124 of the main panel 102 and hence of the locker assembly. In one suitable embodiment, this initial step is conducted prior to packaging of the various components of locker assembly 100 for transport. The inner panels 122 are permanently adhered in place between the inside walls 108 and respective outside walls 110 so that in the laid-flat configuration of the main panel 102 the initial assembly step has already been completed. The inner panels 122 and folding over of the outside walls 110 thus provides the side walls 124 of the locker assembly 100 with a three layer construction for additional strength and rigidity while maintaining a lightweight construction of the assembly.

It is understood that in other embodiments the inner panels 122 may be omitted from the locker assembly without departing from the scope of this invention. It is also contemplated that in still other embodiments the side walls 124 of the locker assembly 100 may be constructed of a single layer or sheet of the construction material instead of the multiple layers used in the illustrated embodiment. In still other embodiments, the initial step of folding the outer walls 110 over the inner walls 108 and adhering the inner panels 122 therebetween may be conducted by the end customer, e.g., such the main panel 102 is entirely unfolded in the packaging and the inner panels 122 are included in the packaging separate from the main panel and in a laid-flat configuration.

Figure 9:
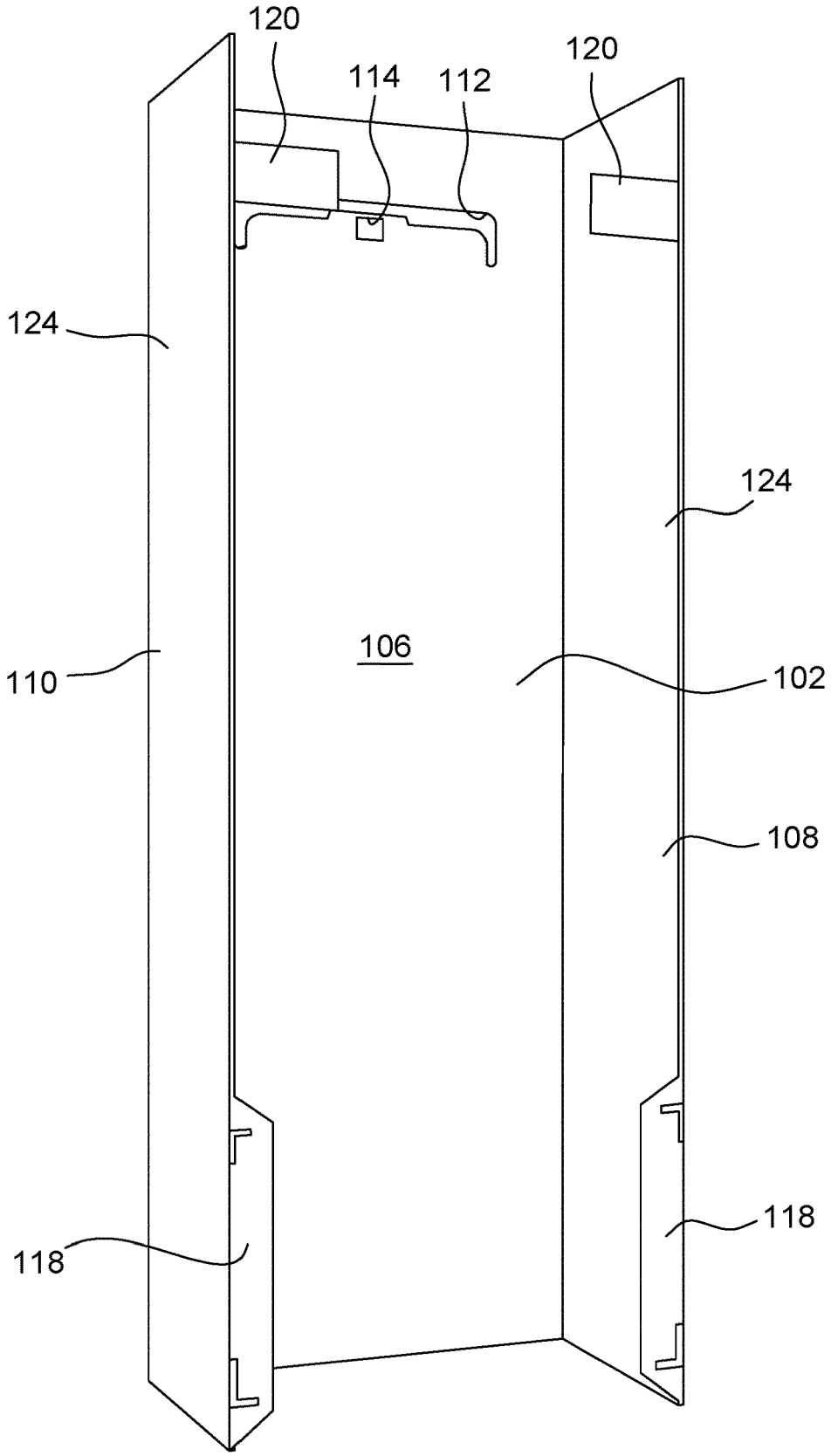
FIG. 9 is a schematic perspective view of the locker assembly of FIG. 1 in a partially assembled configuration.

Following this initial folding step, e.g., when being assembled by the end customer, the upper and lower mounting tabs 120, 118 may be unfolded to extend outward from the edges of the side walls 124 as seen in FIG. 9. Referring still to FIG. 9, in the next folding step the side walls 124 are folded forward from the back wall 106 so that the locker 100—at this early stage of folding and assembly, can already stand upright with the upper and lower mounting tabs 120, 118 extending forward from the side walls.

Figure 6B:
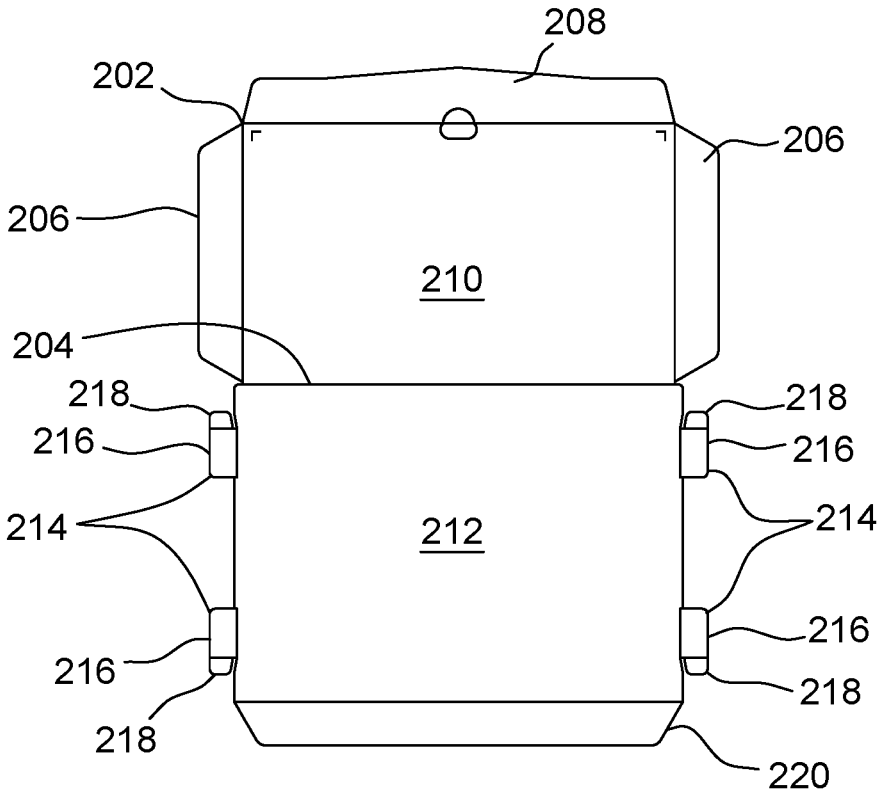
FIG. 6B is a plan view of one embodiment of a suitable a bench panel of the locker assembly of FIG. 1 with the bench panel in an unfolded and laid flat configuration.
Figure 11:
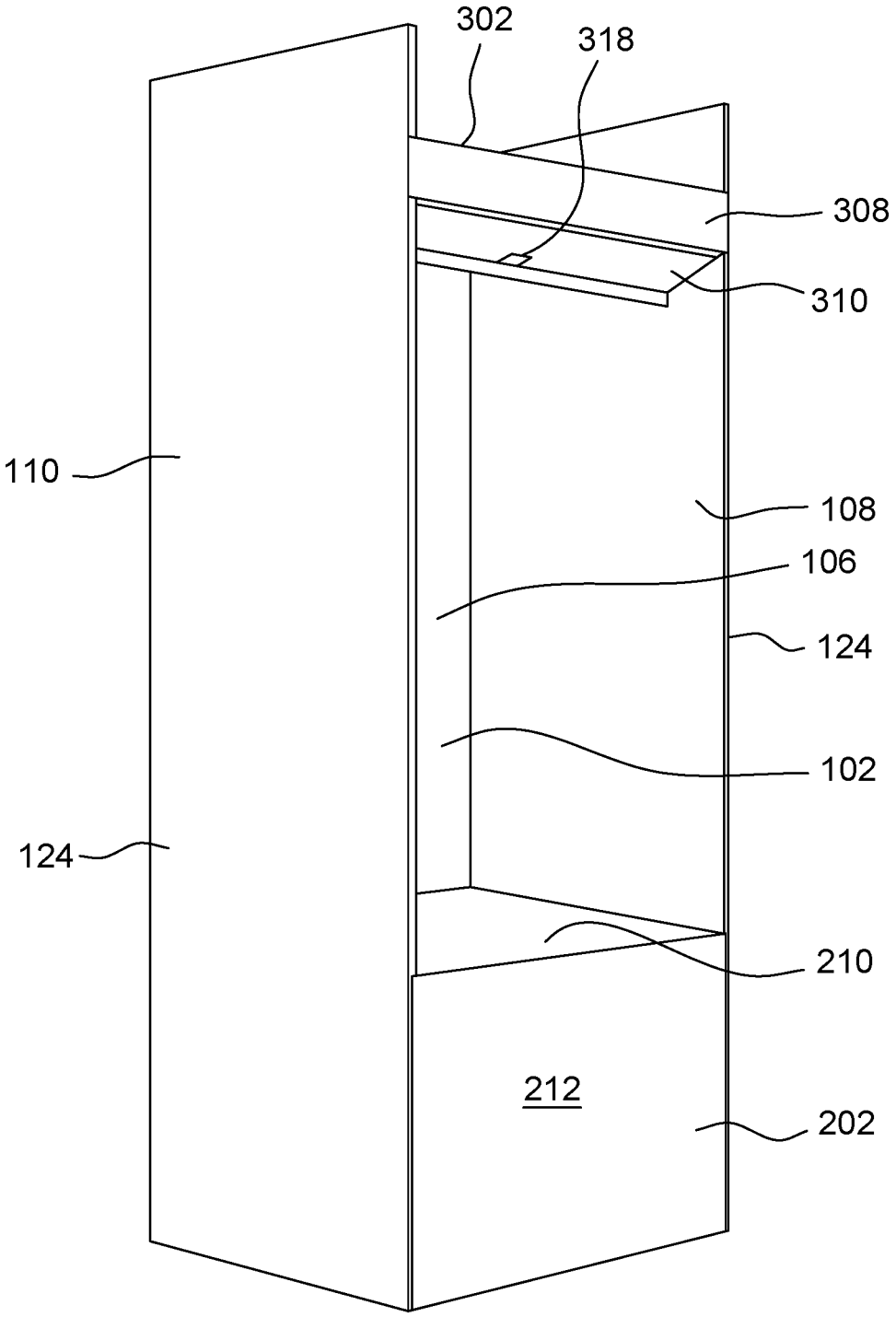
FIG. 11 is a schematic perspective view of the locker assembly of FIG. 1 in a further partially assembled configuration than as shown in FIG. 10.

The bench panel 202, as seen best in FIG. 6B, includes a horizontal (i.e., widthwise in the illustrated embodiment) fold line 204 or crease to define a bench 210 and a front wall 212 of the bench panel. Foldable flaps 206, 208 extend from each of the three free edges of the bench 210 of the bench panel 202. Discrete assembly tabs 214 (four are provided in the illustrated embodiment) extend from and are hinged to each of the side edges of the front wall 212 so that these tabs are foldable relative to the front wall. Each of the assembly tabs 214 includes a respective fold line 216 or crease to define a foldable ear 218 on each of the assembly tabs. As seen in FIG. 11, in the next assembly step the ears 218 on the assembly tabs 214 are folded over and the tabs are inserted through respective slots 128 in the lower mounting tabs 118. The ears 218 are then unfolded to retain the front wall 212 of the bench panel 202 in connection with the side walls 124 of the locker assembly 100. A lower foldable flap 220 extends from the free edge of the front wall 212 and is folded inward relative to the front wall so that the foldable flap rests on the floor or other surface on which the locker assembly is standing. The three foldable flaps 206, 208 hinged to the bench 210 of the bench panel 202 are then folded inward relative to the bench as seen in FIG. 10. This allows the bench 210 to be folded inward relative to the front wall 212 with the flaps 206 along the side edges of the bench to be received into the locker assembly 100 within and adjacent to the side walls 124 of the locker assembly.

In the illustrated embodiment, the bench panel 202 is formed separate from the main panel 102 and is connectable thereto in the manner described above to retain the bench panel on the main panel. It is understood that in other embodiments the bench panel 202 may be initially formed integral with the main panel 102 (e.g., from a single sheet of material) and then separated therefrom prior to being folded and connected to the main panel. In still other embodiments, the bench panel 202 may be formed integral with the main panel 102 and be foldable relative to the main panel into its folded configuration to form the bench 210.

Figure 7:
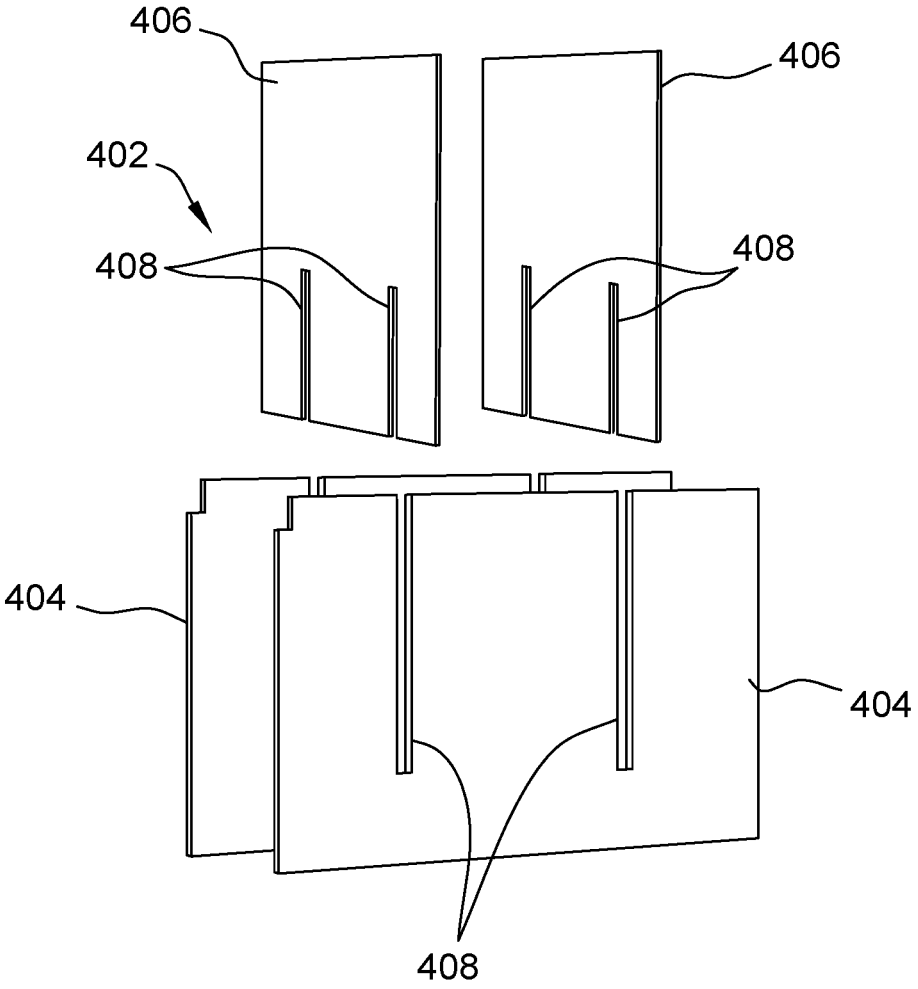
FIG. 7 is an exploded perspective of one embodiment of a suitable bench support of the locker assembly of FIG. 1.

Referring to FIGS. 7 and 10, the bench support 402 of the illustrated embodiment is of four-piece construction including two pairs of respective cross panels 404, 406 having slots 408 that allow one pair of the cross panels to be interlocked with the other pair of cross panels to form a grid pattern. As seen in FIG. 10, the assembled bench support 402 is then placed into the locker assembly 100 within the interior space or compartment formed by the back wall 106 and side walls 124 of the locker 100 along with the bench 210 and the front wall 212 of the bench panel 202. The bench support 402 will rest in part on the floor or other surface on which the locker assembly 100 is standing and in part on the lower foldable flap 220 of the front wall 212 of the bench panel 202. It is understood that the bench support 402 may be of any other suitable construction without departing from the scope of this invention. For example, it may be constructed from more than four separate pieces of material, or it may be constructed of a single, foldable piece of material, as long as it is capable of being configured in a generally laid-flat configuration for packaging and storage.

With the bench support 402 in place, the bench 210 of the bench panel 202 is further folded inward over the bench support until the foldable flap 206 hinged to the front edge of the bench portion 210 extends through the lower slot 116 formed in the back wall 106 of the locker assembly 100 (see, e.g., FIG. 2) to thus secure the bench 210 of the bench panel 202 to the back wall. In this manner, the bench support 402 provides support to the bench 210 sufficient to allow an average person to sit on the bench despite the lightweight construction of the locker assembly 100. It will be understood that the grid pattern of the bench support 402 also allows items to be stored within the bench support by lifting up the bench portion 210 of the bench panel 202 to access the bench support. Because the bench 210 is releasably connected to the back wall 106 of the locker assembly 100, it can be repeatedly opened and closed to access the bench support 402 and/or any contents that are stored in the same compartment.

The shelf panel 302, with reference to FIGS. 1, 3, 6A and 11, includes a plurality of cross-wise extending fold lines 304 that define a shelf 306, a front portion 308 and a retaining flap 310. Three foldable flaps 312, 314 extend outward along the free edges of the shelf 306 of the shelf panel 302. In the shown embodiment, adhesive material 316 (with suitable non-stick liners thereon) is applied to the retaining flap 310 of the shelf panel 302. Similar adhesive material 126 (FIG. 5) is applied to the upper mounting tabs 120 of the main panel 102. A slot 318 is formed in the retaining flap 310 for subsequently mounting the holding bar 502 on the locker assembly 100. To assemble the shelf panel 302 onto the locker assembly 100, as seen in FIG. 11, the foldable flaps 312 along the side edges of the shelf portion 306 are folded inward and with the shelf panel 302 held generally upright the foldable flap 314 along the back edge of the shelf portion of the shelf panel is inserted into the upper slot 112 in the back wall 106 of the main panel 102. The respective liners are removed from the adhesive material 126 on the upper mounting tabs 120 of the main panel 102 and also the additional respective liners are removed from the adhesive material 316 on the retaining flap 310 of the shelf panel 302.

The upper mounting tabs 120 on the main panel 102 are then folded inward of the locker assembly 100 so as to generally form a 90-degree angle with the side walls 124. The shelf 306 of the shelf panel 302 is then folded downward until the shelf portion rests on the upper mounting tabs 120 (see, e.g., FIG. 3) generally at the fold line 304 between the shelf portion 306 and the front portion 308 of the shelf panel. The front portion 308 of the shelf panel 302 is then folded down over the upper mounting tabs 120. The retaining flap 310 is then further folded around and behind the upper mounting tabs 120 (FIG. 3) so that the adhesive material 316 on the retaining flap 310 engages the adhesive material 126 on the upper mounting tabs 120 to thereby further secure the shelf panel 302 to the main panel 102 of the locker assembly 100.

In the illustrated embodiment, the shelf panel 302 is formed separate from the main panel 102 and bench panel 202 and is connectable to the main panel in the manner described above to retain the shelf panel on the main panel. It is understood that in other embodiments the shelf panel 302 may be initially formed integral with the main panel 102 and/or the bench panel 202 (e.g., from a single sheet of material) and then separated therefrom prior to being folded and connected to the main panel. In still other embodiments, the shelf panel 302 may be formed integral with the main panel 102 and be foldable relative to the main panel into its folded configuration to form the shelf 306.

Figure 8:
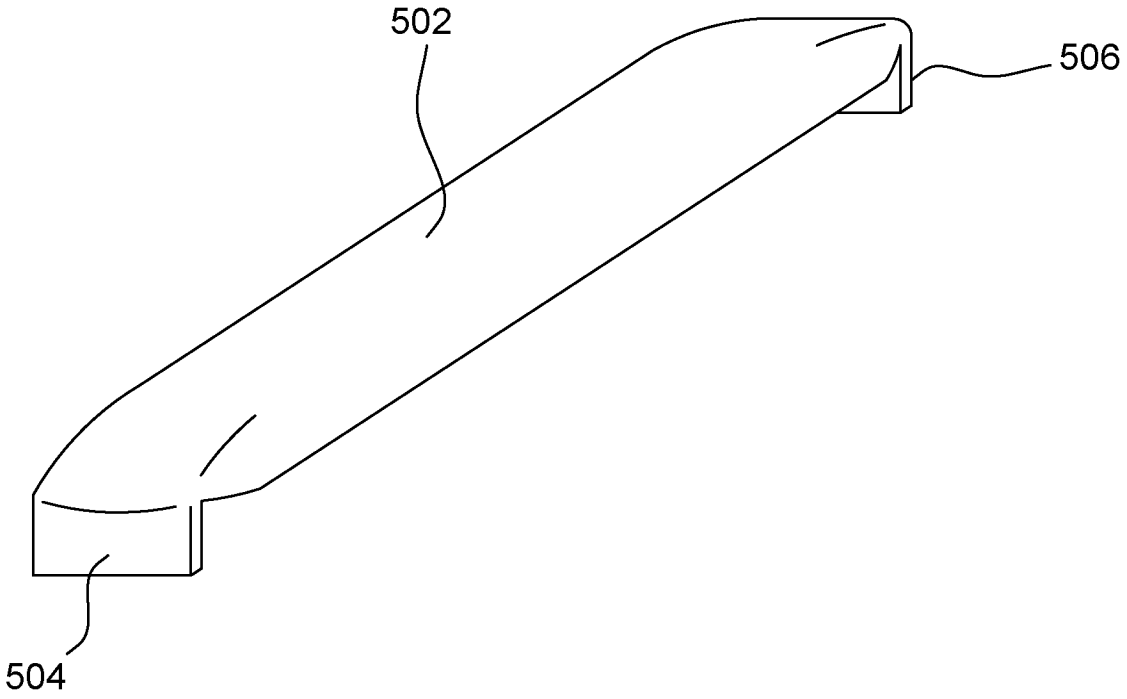
FIG. 8 is a perspective view of one embodiment of a suitable hanging bar of the locker assembly of FIG. 1.

With reference to FIG. 8, the hanging bar 502 includes a pair of mounting tabs 504, 506 bent generally at a right angle to the bar and shaped to be generally flat. It is understood that the bar 502 itself may be of any suitable shape in cross-section, such as flat, round, semi-round and the like as long as the mounting tabs 504, 506 at the opposite ends of the bar are generally flat. To complete assembly of the locker 100, the mounting tab 504 at one end of the hanging bar 502 is inserted into the slot 318 formed in the retaining flap 310 and then the mounting tab 506 at the opposite end of the hanging bar is inserted into the separate slot 114 formed in the back wall 106 of the main panel 102 just below the upper slot 112 (see, e.g., FIG. 1). The hanging bar 502 allows clothes, towels or other hanging items to be suspended in the locker assembly 100, such as on hangars. In the disclosed embodiment, the hanging bar 502 is constructed of a metal, such as aluminum, steel, alloys or other suitable metals. It is understood, however, that the hanging bar 502 may be made from paperboard, plastic or other suitable material without departing from the scope of this invention.

In the shown embodiment, the locker assembly 100 is of a generally plain appearance, such as a solid white or brown color. This allows the locker assembly 100 according to one embodiment to be decorated in any manner that the user desires. For example, crayons, markers, stickers or other decorating materials may be used to decorate the locker in a manner desired by the user. In other embodiments, it is contemplated that text, images, illustrations, photographs, logos or other indicia may be imprinted over all or part of the locker assembly 100 to give the locker assembly the appearance of a sports locker, golf club locker, office locker, hunting equipment locker or other desired environment.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A foldable locker assembly configurable between a generally laid flat configuration and an assembled configuration in which the assembly generally forms a locker, the locker assembly comprising:

a main panel configurable between a generally laid-flat configuration and a folded configuration, in the folded configuration the main panel forming a back wall and opposite side walls of the locker assembly;

a shelf panel configurable between a generally laid-flat configuration and a folded configuration, in the folded configuration the shelf panel at least in part forming a shelf of the locker assembly; and a bench panel configurable between a generally laid-flat configuration and a folded configuration, in the folded configuration the bench panel at least in part forming a bench of the locker assembly, said bench being in spaced relationship with the shelf panel;

wherein the main panel has an upper terminal end and a lower terminal end, the lower terminal end of the main panel defining a bottom of the locker assembly in the folded configuration of the main panel, the bench panel in its folded configuration and in assembly with the main panel being configured and arranged relative to the main panel with the bench being spaced from the bottom of the locker assembly such that the back wall and opposite side panels of the main panel, together with the bench panel, define a compartment adjacent and open to the bottom of the locker assembly.

2. The foldable locker assembly of claim 1 wherein the main panel has at least two fold lines formed therein, the main panel being foldable along the fold lines to form the back wall and opposite side walls of the locker assembly in the folded configuration of the main panel.

3. The foldable locker assembly of claim 1 wherein in the main panel has at least four fold lines to define the back wall, a pair of inside walls and a pair of outside walls, each outside wall being foldable relative to an adjacent corresponding inside wall into superposed relationship therewith to together form one of the side walls of the locker assembly such that each of the sidewalls is of two layer construction.

4. The foldable locker assembly of claim 3 further comprising a pair of inner panels formed separate from the main panel, each inner panel being insertable between one of the inside walls and the corresponding one of the outside walls upon folding of the outside wall relative to the inside wall such that the side wall formed thereby is of a three layer construction.

5. The foldable locker assembly of claim 1 wherein the main panel is constructed of paperboard.

6. The foldable locker assembly of claim 1 wherein at least one of the shelf panel and the bench panel is at least in part releasably connectable to the main panel.

7. The foldable locker assembly of claim 1 further comprising a bench support configurable between a generally laid flat configuration and a support configuration, in the support configuration the bench support being positionable in said compartment to support the bench of the bench panel.

8. The foldable locker assembly of claim 1 wherein the bench of the bench panel is moveable relative to the main panel and a remainder of the bench panel to permit access to said compartment.

9. The foldable locker assembly of claim 7 wherein the bench support comprises at least four discrete cross panels, the cross panels each being generally flat for being configurable in the generally laid flat configuration of the bench support, the cross panels being configured for assembly together in a generally grid pattern to define the support configuration of the bench support.

10. The foldable locker assembly of claim 1 further comprising a hanging bar, the hanging bar being connectable to at least one of the main panel and the shelf panel in the folded configurations thereof.

11. The foldable locker assembly of claim 10 wherein the hanging bar has opposite ends, each end of the hanging bar forming a mounting tab, one mounting tab being connectable to the back wall of the main panel and the other mounting tab being connectable to the shelf panel to retain the hanging bar on the locker assembly.

12. The foldable locker assembly of claim 1 wherein the shelf panel is formed separate from the main panel and is connectable to the main panel in the folded configurations thereof to retain the shelf panel on the main panel.

13. The foldable locker assembly of claim 1 wherein the shelf panel is formed integral with the main panel and is one of: detachable from the main panel before configuring the shelf panel in its folded configuration and then being connectable to the main panel, and foldable relative to the main panel into the folded configuration of the shelf panel.

14. The foldable locker assembly of claim 1 wherein the bench panel is formed separate from the main panel and is connectable to the main panel in the folded configurations thereof to retain the bench panel on the main panel.

15. The foldable locker assembly of claim 1 wherein the bench panel is formed integral with the main panel and is one of: detachable from the main panel before configuring the bench panel in its folded configuration and then being connectable to the main panel, and foldable relative to the main panel into the folded configuration of the bench panel.

16. The foldable locker assembly of claim 1 wherein the bench panel, in its folded configuration and unassembled with the main panel of the locker assembly, does not define a compartment.

17. A foldable locker assembly configurable between a generally laid flat configuration and an assembled configuration in which the assembly generally forms a locker, the locker assembly comprising:

a main panel configurable between a generally laid-flat configuration and a folded configuration, in the folded configuration the main panel forming a back wall and opposite side walls of the locker assembly;

a shelf panel configurable between a generally laid-flat configuration and a folded configuration, in the folded configuration the shelf panel being capable of assembly with the main panel to at least in part form a shelf of the locker assembly; and a bench panel configurable between a generally laid-flat configuration and a folded configuration, in the folded configuration the bench panel being capable of assembly with the main panel to at least in part form a bench of the locker assembly, said bench being in spaced relationship with the shelf panel, wherein the main panel has an upper terminal end and a lower terminal end, the lower terminal end of the main panel defining a bottom of the locker assembly in the folded configuration of the main panel, the bench panel in its folded configuration and in assembly with the main panel being configured and arranged relative to the main panel with the bench being spaced above the bottom of the locker assembly such that the back wall and opposite side panels of the main panel, together with the bench panel, define a compartment adjacent the bottom of the locker assembly and having an interior space with the back wall of the main panel being directly exposed to the interior space of the compartment.

* * * * *